US005893247A

United States Patent [19]

Hickman et al.

[11] Patent Number: 5,893,247

[45] Date of Patent: Apr. 13, 1999

[54] COPING

[75] Inventors: John B. Hickman, Asheville; Kevin Pressley, Canton; Rick Rhinehart, Candler; Curtis Roberts, Weaverville; Don Schultz, Asheville; Richard Tuttle, Hendersonville, all of N.C.

[73] Assignee: W. P. Hickman Company, Asheville, N.C.

[21] Appl. No.: 09/006,247

[22] Filed: Jan. 13, 1998

[51] Int. Cl.[6] ..... E04F 19/02

[52] U.S. Cl. ..... 52/300; 52/60

[58] Field of Search ..... 52/58, 60, 94, 52/96, 300

[56] References Cited

U.S. PATENT DOCUMENTS

| | | | |
|---|---|---|---|
| 3,351,958 | 11/1967 | Shields | 52/300 |
| 3,802,140 | 4/1974 | Hickman . | |
| 3,818,663 | 6/1974 | Adlam . | |
| 3,862,531 | 1/1975 | Attaway et al. . | |
| 4,083,158 | 4/1978 | Wolma . | |
| 4,550,535 | 11/1985 | Drogosch . | |
| 4,858,406 | 8/1989 | Lane et al. . | |
| 5,189,853 | 3/1993 | Braine et al. . | |
| 5,239,791 | 8/1993 | Mills, Jr. et al. . | |
| 5,289,662 | 3/1994 | Castle . | |

OTHER PUBLICATIONS

Peterson Aluminum Corporation "*Coping Systems*", pp. 22–23.

MM Systems Co., "*Snap–Lok Coping Systems*", pp. 8–13.

Hickman, Wall Caps/ Gravel Stop, "*Permasnap Coping*", p. 2.

Southern, EP Coping, "*Engineered Plastic*", pp. 14–16.

*Primary Examiner*—Michael Safavi

*Attorney, Agent, or Firm*—Harness, Dickey & Pierce, P.L.C.

[57] ABSTRACT

A coping system for parapet is comprised of three separate components, a plurality of cleats, a plurality of chairs and a plurality of caps. The cleats are secured to the parapet at spaced intervals and each cleat supports a corresponding chair. Each cap extends between at least two cleats and chairs. Adjacent caps are spaced from each other forming a gap between the caps with the gap being located directly above the chair. The chair forms a gutter for routing water away from the top of the parapet. The chair biases the cap away from the parapet to maintain the engagement between the cap and the cleat. All three components are made entirely of metal providing a sealed joint between adjacent caps without the use of organic compounds.

24 Claims, 5 Drawing Sheets

COPING

FIELD OF THE INVENTION

The present invention relates to a coping system for a masonry wall. More particularly, the present invention relates to a coping system having an internal locking action which does not rely upon any organic compounds for support that could degrade under the severe heating and cooling cycles to which exterior coping products are subjected.

BACKGROUND OF THE INVENTION

Buildings, particularly those having flat roofs, generally include parapets or comparable structures extending above the roof line on one or more sides. The parapets perform two functions. First, they enhance the aesthetic appearance of the building. Second, they prevent rain water and other fluids from flowing from the roof and onto the face of the building. Eliminating the flow of fluids onto the face of the building helps to maintain the appearance of the building by reducing discoloration of the face as well as helping to maintain the structural integrity of the components used for the building face.

Parapets extend above the roof line and usually terminate in a flat ledge extending the length of the parapet. The flat edge is exposed to the atmosphere and thus requires protection from moisture and the other elements of nature. Copings have been developed to cover, or cap, the flat ledge of the parapets. Generally, these copings are manufactured from metal or plastic and are designed to extend over the entire width of the flat ledge and redirect any fluids such as rain away and off of from the flat ledge.

One of the simplest copings is a single sheet of material extending the length of the parapet. While this type of coping provides some protection, designs which allow a varying width of the flat ledge and designs which provide an inclined surface for the fluid run off have significantly improved the performance of copings. These newer designs for copings include a plurality of anchoring elements or hold down cleats which are attached at predetermined spaced intervals along the flat ledge of the parapet by screws, bolts, nails or other means known in the art. Usually, some type of sealing device is attached to the hold down cleats and a cover or coping element is assembled to adjacent hold down cleats with additional sealing being provided between the cleat and the coping element. The hold down cleat usually includes some type of spacer which will provide for the inclining of the top surface of the coping element to direct fluid flow away from the building face and onto the roof top.

While the newer designs for copings have significantly improved the performance of copings, the interface between the hold down cleats and the coping element has proven to be an area requiring additional development. The hold down cleat can sag due to its own weight or form the weight of water and ice allowing deterioration of the sealing between the components and thus the leaking of fluid onto the parapet itself. In addition, the use of organic supports (plastic chairs, foam inserts and the like) is not compatible with long term durability of the coping system. Organic components can deteriorate over many years due to the high temperatures generated under the coping cover in hot sunny climates. In cold climates, low temperatures make organic components venerable to embrittlement and cracking. In intermediate climates, the continued cycling between high temperatures and low temperatures also has a detrimental effect on the durability of the organic compounds.

Accordingly, continued development of coping systems has been directed towards improved systems for holding the coping plate on the parapet and improving the interface between the coping cover plate and the hold down cleats especially at the joining of adjacent coping cover plates.

SUMMARY OF THE INVENTION

The present invention provides a coping system which eliminates the need for using organic components for support. The coping system of the present invention uses a plurality of securement cleats and supports which are manufactured entirely of metal. A coping cover is assembled to the cleats and internal supports with a gap being maintained between adjacent covers to allow for the normal expansion and contraction during temperature extremes. The sealing between the supports and the cover depends upon the spring action of the sides of the supports pushing against the underside of the coping cover.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE EMBODIMENT

Figure 1:
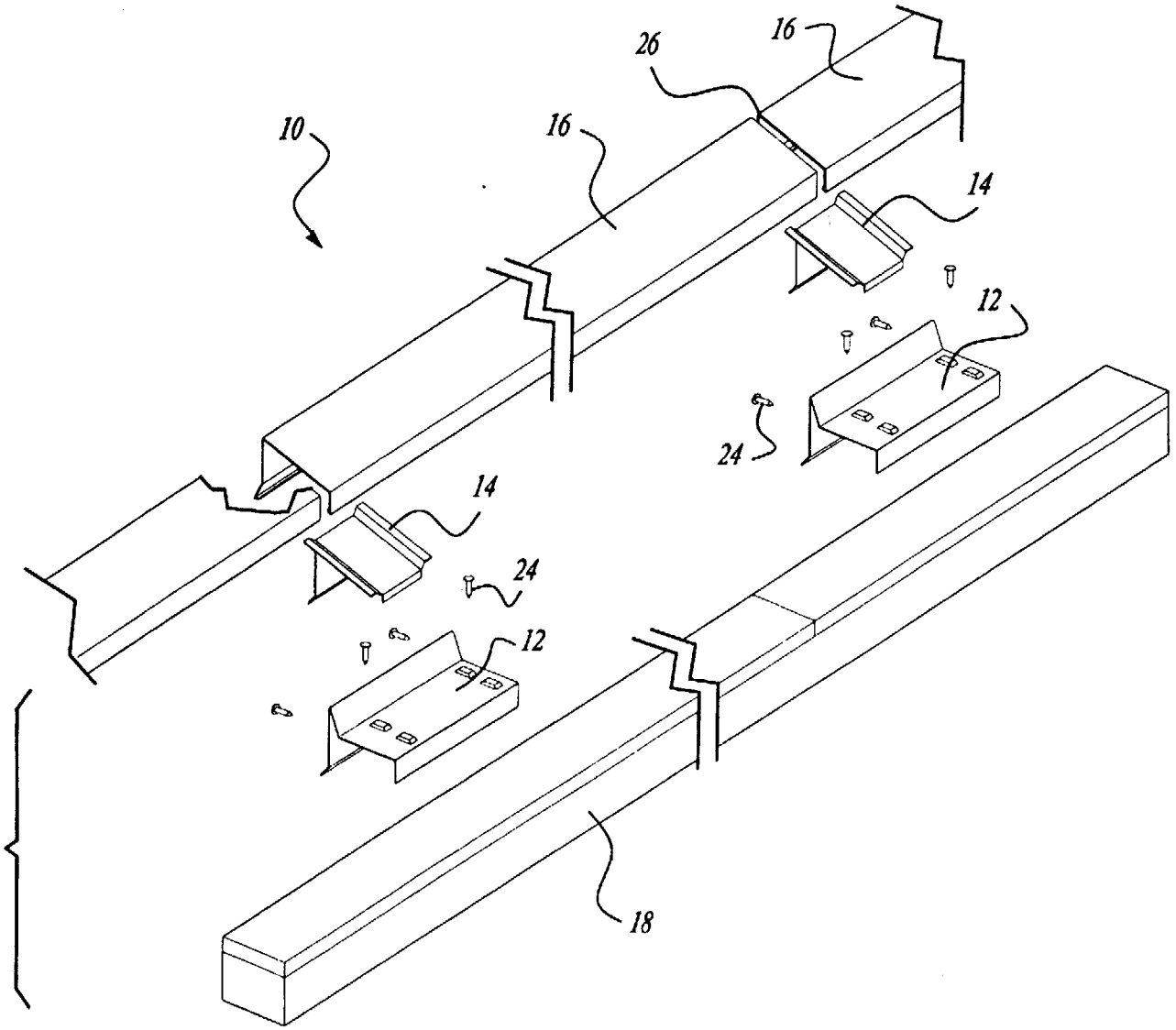
FIG. 1 is an exploded perspective view of a coping system in accordance with the present invention.
Figure 2:
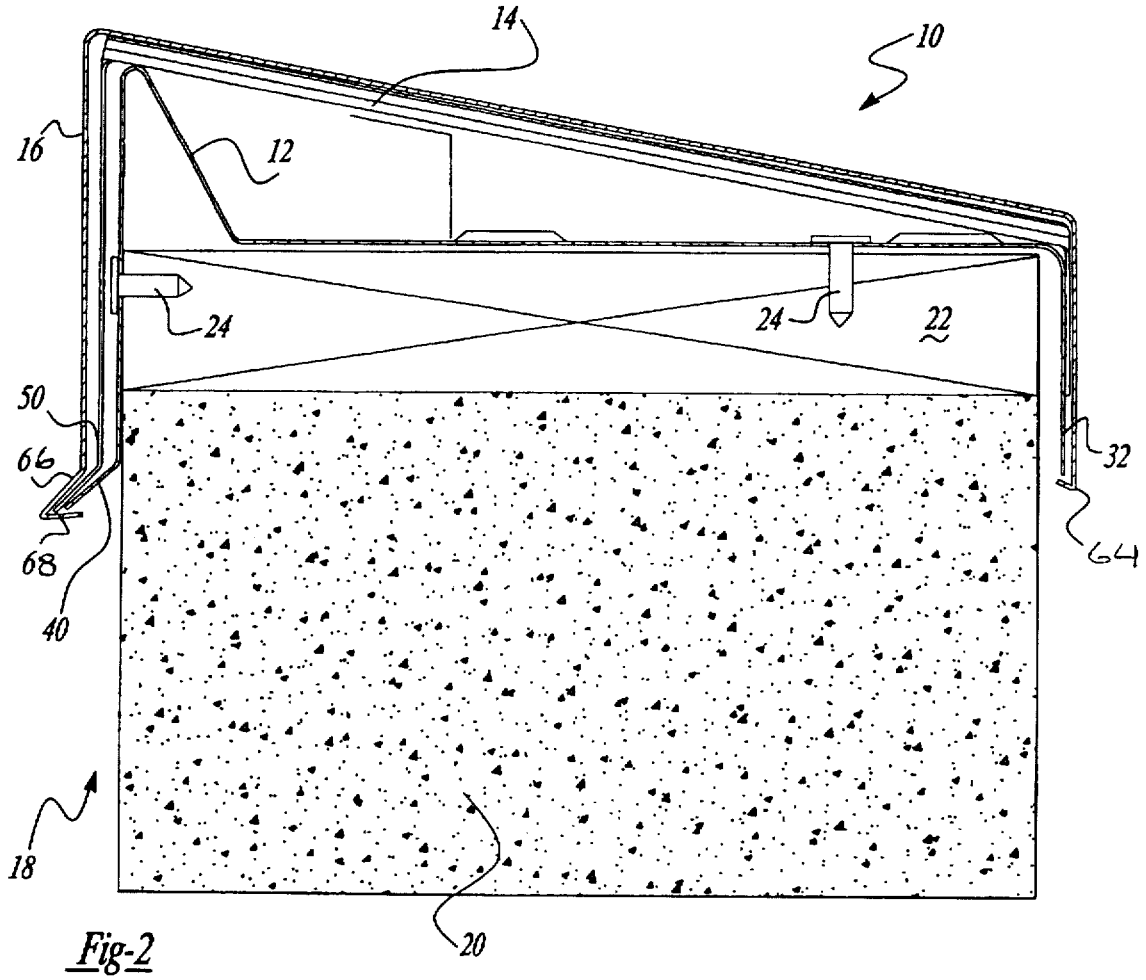
FIG. 2 is a cross-sectional view of the coping system shown in FIG. 1 taken through the joint.

Referring now to the drawings in which like reference numerals designate like or corresponding parts throughout the several views, there is shown in FIG. 1 a coping system in accordance with the present invention which is designated generally by the reference numeral 10. Coping system 10 comprises a cleat 12, a chair/joint cover 14 and a cap 16. Coping system 10 is shown in FIGS. 1 and 2 in conjunction with a parapet 18 which is part of a building (not shown). FIG. 1 illustrates, for exemplary purposes, coping system 10 having a plurality of cleats 12, chair/joint covers 14 and caps 16. It is to be understood that coping system 10 can include additional cleats 12, chair/joint covers 14 and caps 16 which can be assembled along parapet 18 to cover the length of parapet 18.

Referring now to FIGS. 1 and 2, parapet 18 is shown as having a masonry type body 20 and a wooden cap or blocking 22. Each cleat 12 is secured to blocking 22 using a plurality of fasteners 24. While parapet 18 is shown for exemplary purposes having masonry body 20 and blocking 22, it is to be understood that coping system 10 can be secured to any type of parapet by using the appropriate fasteners for securing cleat 12 to the parapet. Each cleat 12 is provided with a corresponding chair/joint cover 14 while is centrally located atop cleat 12. Finally, caps 16 are assembled to the plurality of cleats 12 and chair/joint covers 14 with adjacent caps 16 defining a gap 26 centrally located over a respective chair/joint covers 14. Cleats 12 and chair/joint covers 14 which are located intermediate of a joint serve to support caps 16 across their width to maintain positive drainage and supply internal locking action for coping system 10.

Figure 3:
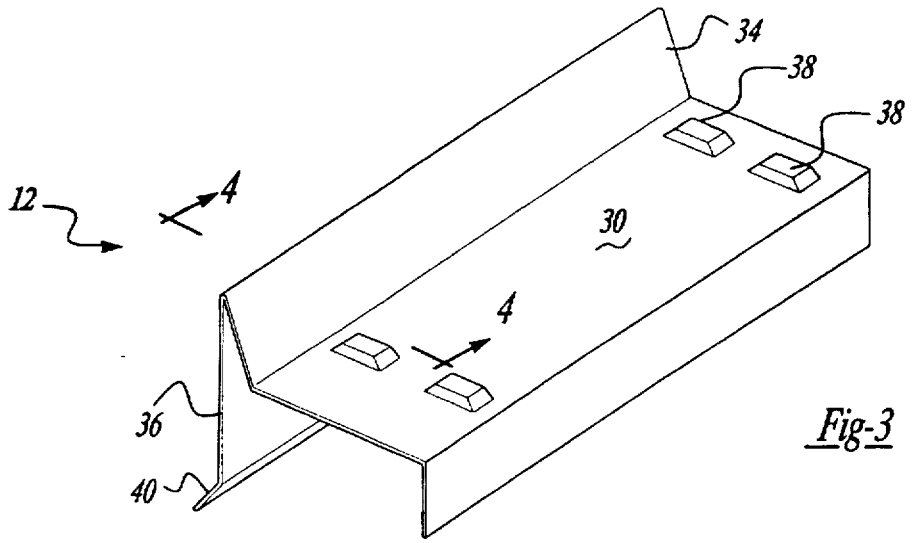
FIG. 3 is a perspective view of the cleat shown in FIG. 1.
Figure 4:
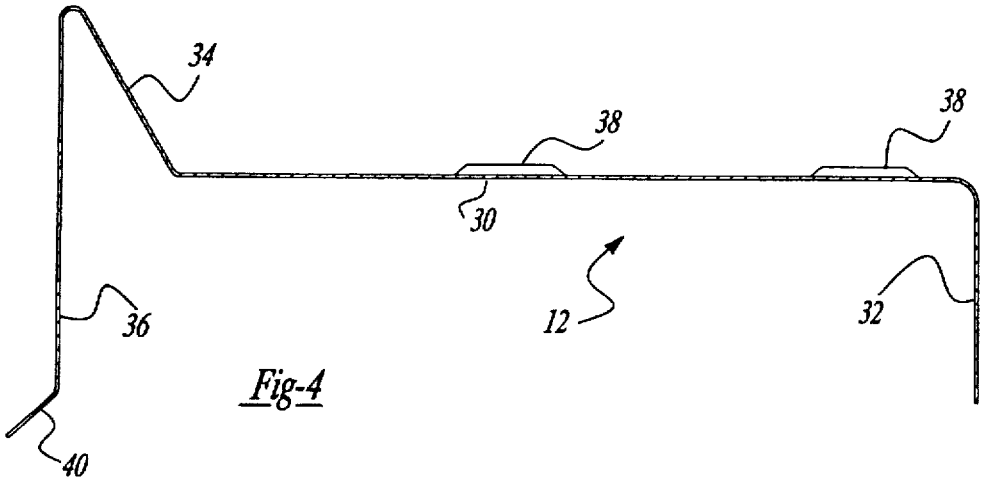
FIG. 4 is a cross-sectional view through the cleat shown in FIG. 3.

Referring now to FIGS. 3 and 4, cleat 12 comprises a generally flat horizontal base 30, a rear lip 32, a raised support member 34 and a front lip 36. Base 30 is designed to rest on blocking 22 or the top of parapet 18. A plurality of ribs 38 can be formed into base 30 to provide stiffening support if desired. Rear lip 32 extends downward from base 30 along the inside edge of parapet 18. The angle between base 30 and rear lip 32 is greater than 90° (95° in the preferred embodiment) to provide a locking engagement with cap 16 as will be described later herein. Raised support member 34 extends upward from base 30 in order to incline the upper surface of cap 16 to the rear of cleat 12 such that any fluid which contacts cap 16 will be directed onto the top of the roof and not onto the face of the building. Front lip 36 extends downward from raised support member 34 along the outside edge of parapet 18. The angle between base 30 and front lip 36 is approximately 90° in the preferred embodiment. The edge of front lip 36 includes a lip 40 which is designed to extend away from parapet 18 to form a drip edge as will be explained later herein. Cleat 12 is secured to parapet 18 using the plurality of fasteners 24 as shown in FIGS. 1 and 2.

Figure 5:
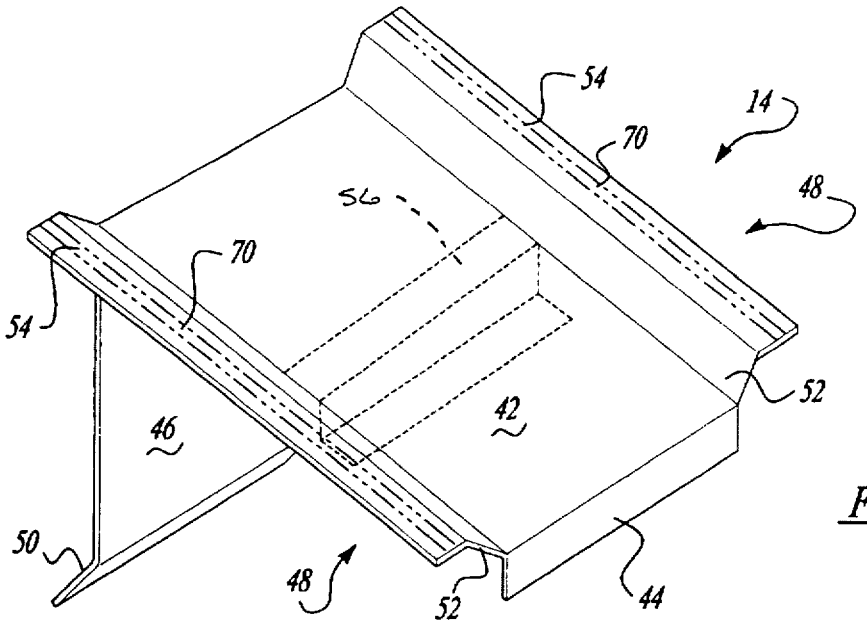
FIG. 5 is a perspective view of the chair/joint cover shown in FIG. 1.
Figure 6:
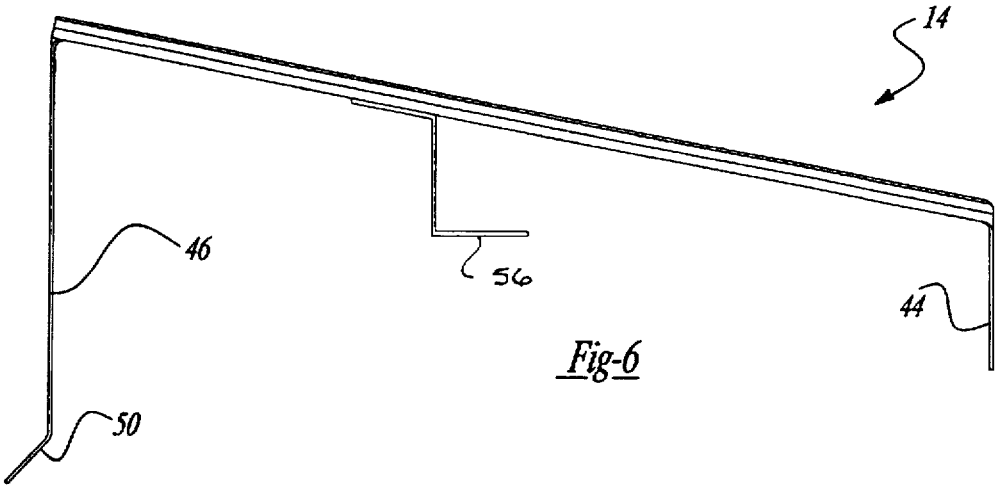
FIG. 6 is a cross-sectional view through the chair shown in FIG. 5.

Referring now to FIGS. 5 and 6, chair/joint cover 14 comprises a generally planar base 42, a rear lip 44, a front lip 46 and a pair of wings 48. Base 42 is designed to extend between the rear edge of base 30 of cleat 12 and the top of support member 34 of cleat 12. Base 42 creates a gutter which collects fluid dropping through gap 26 between adjacent caps 16 and channels this fluid to the top of the roof. Rear lip 44 extends downward from base 42 along the outside of rear lip 32 of cleat 12. The angle between base 42 and rear lip 44 is generally equal to the angle between base 30 and rear lip 32 of cleat 12 (95° in the preferred embodiment). This angle in conjunction with the inclined position of base 42 retains chair/joint cover 14 in position on cleat 12 due to the spring-like action of rear lip 44 and front lip 46. Front lip 46 extends downward from base 42 along the outside edge of front lip 36 of cleat 12. The angle between base 42 and front lip 46 is approximately 85° in the preferred embodiment. This angle in conjunction with the inclined position of base 42 allows for the mating of front lip 46 with front lip 36 and the mating of base 42 with base 30 and allowing rear lip 32 to flex to provide for the spring-like retention of chair/joint cover 14 on cleat 12. The edge of front lip 46 includes a lip 50 which mates with lip 40 to form a drip edge as will be described later herein. Each wing 48 includes a vertical section 52 which extends angularly upward from base 42 and a generally horizontal section 54 which extends away from base 42. In the preferred embodiment, vertical section 52 extends at an inclined angle of 145° with respect to base 42 and horizontal section 54 extends at an included angle of 155° with respect to vertical section 52 to provide a 10° upward angle of horizontal section 54 with respect to base 42. The angular relationship of vertical section 52 and horizontal section 54 with respect to base 42 provides for the spring action of sections 52 and 54 and the subsequent pushing up of wings 48 against cap 16 for supporting cap 16 and sealing between these components. An S-shaped supporting rib 56 is secured to the underside of chair/joint cover 14 to improve its stiffness.

Figure 7:
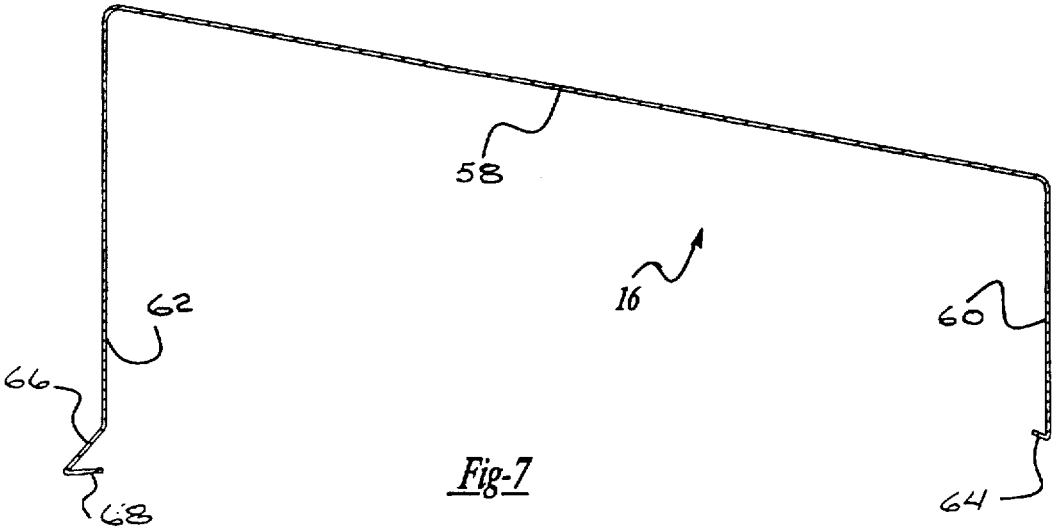
FIG. 7 is a cross-sectional view through the coping cap shown in FIG. 1.

Referring now to FIG. 7, cap 16 comprises a generally planar base 58, a rear lip 60 and a front lip 62. Base 58 is designed to extend over the front and rear edges of the assembly comprising cleat 12 and chair/joint cover 14. The spacing between a pair of cleats 12 and chair/joint covers 14 is selected such that the ends of cap 16 extend down the center line of chair/joint covers 14. Additional cleats 12 and chair/joint covers 14 can be positioned between the ends of each cap 16 to provide additional support and retention of cap 16 as each individual building and location dictate. Rear lip 60 extends downward from base 58 along the outside of rear lip 44 of chair/joint cover 14. The angle between base 58 and rear lip 60 is generally smaller than the angle between base 42 and rear lip 44 of chair/joint cover 14 (91° in the preferred embodiment). This slightly smaller angle provides for a spring-like snap fit of cap 16 onto chair/joint cover 14 and cleat 12. The edge of rear lip 60 is bent over to form a hook 64 which engages the edge of rear lip 32 of cleat 12 to retain cap 16 on cleats 12 as shown in FIG. 2 sandwiching chair/joint cover 14 between cleat 12 and cap 16. Front lip 62 extends downward from base 58 along the outside edge of front lip 46 of chair/joint cover 14. The angle between base 58 and front lip 62 is the same as the angle between base 42 and front lip 46 of chair/joint cover 14 (85° in the preferred embodiment). This angle allows for the mating of front lip 62 with front lip 46 and the mating of base 58 with horizontal section 54 of chair/joint cover 14 and allowing rear lip 60 to flex to provide for the spring-like retention of cap 16 on cleat 12. In addition, the angular position of vertical section 52 and horizontal section 54 with respect to base 42 of chair/joint cover 14 provides the spring action between wings 48 and cap 16 for sealing the interface between these components. The edge of front lip 62 includes a lip 66 which when assembled to chair/joint covers 14 and cleats 12 mates with lips 40 and 50 to stiffen the edge of cap 16 and define a drip edge for directing fluid flow away from the front face of parapet 18 and thus the front face of the building. The edge of lip 66 forms a hook 68 which engages the edge of lips 40 of cleats 12 and lips 50 of chair/joint covers 14 to retain cap 16 on cleats 12. The spring-like action of rear lip 32 of cleats 12 and the spring-like action of wings 48 ensure the continuous engagement of hooks 64 and 68 with cleat 12. This continuous engagement allows cap 16 to remain in place and withstand environmental factors such as wind gusts and the like.

Chair/joint cover 14 adds a mechanical spring and support element which allows hook 68 of front lip 62 to be engaged with cleat 12 and then allowing rear lip 60 of cap 16 to be pushed over cleats 12 and chair/joint covers 14 by an installer with the spring-like action of wings 48 lifting cap 16 to engage hook 64 with cleats 12 to complete the installation of coping system 10. This internal locking action of hooks 64 and 68 does not rely upon any organic compound that could degrade under the severe heating and cooling cycles to which coping system 10 could be subjected.

Chair/joint covers 14 and cleats 12 also serve as a unique concealed water collecting gutter at each gap 26 between adjacent exterior caps 16. Gap 26 is created to permit free moving of caps 16 through their normal range of thermal expansion and contraction. Wings 48 of chair/joint covers 14 close tightly to the underside of caps 16 to provide for sealing engagement. The gutter formed by chair/joint cover 14 has a positive slope to drain fluids which might enter the joint back to the top of the roof. This internal drainage along with the positive slope of cap 16 from front to rear protects building faces and veneers from fluid borne stains.

In addition, chair/joint covers 14 can be made from and finished in the same color as cap 16 and become a concealed joint splice between adjacent caps 16. Concealed joint splices in a finish matching caps 16 present a pleasing sight line to enhance the appearance of the building. Intermediate cleats 12 and chair/joint covers 14 or those not used beneath an individual gap 26 serve to support cap 16 across its width to maintain positive drainage and supplement the internal locking action for cap 16.

Coping system 10, detailed above, does not require the use of organic sealing elements to provide for sealing the ledge of parapet 18. If desired, an elastomeric gasket 70 can be installed on wings 48 of chair/joint covers 14 as shown in phantom in FIG. 5. Gasket 70 would be relatively thin and would not violate the principle of the present invention of not having organic supports that could fail. This is because the present invention does not depend on gasket 70 to provide support for cap 16.

Figure 9:
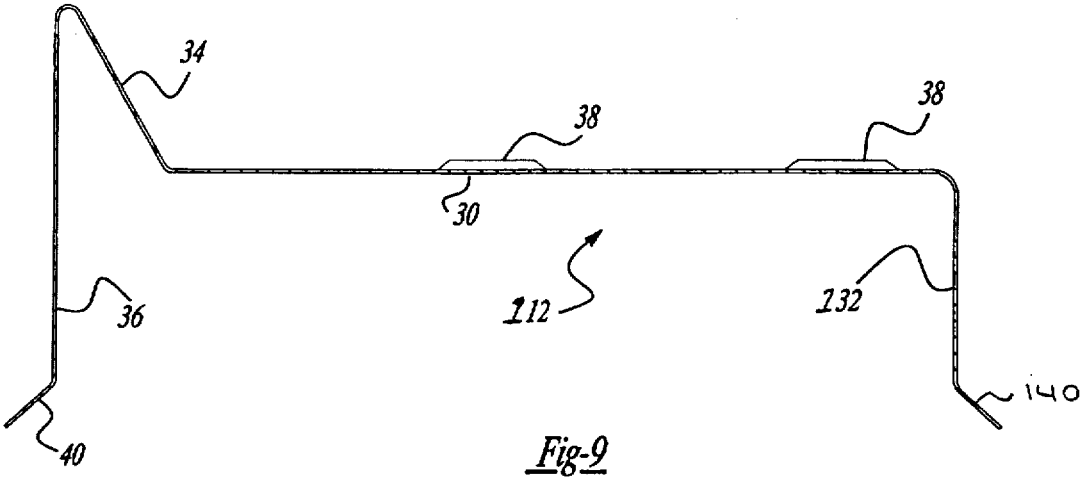
FIG. 9 is a cross-sectional view through the cleat shown in FIG. 8.
Figure 10:
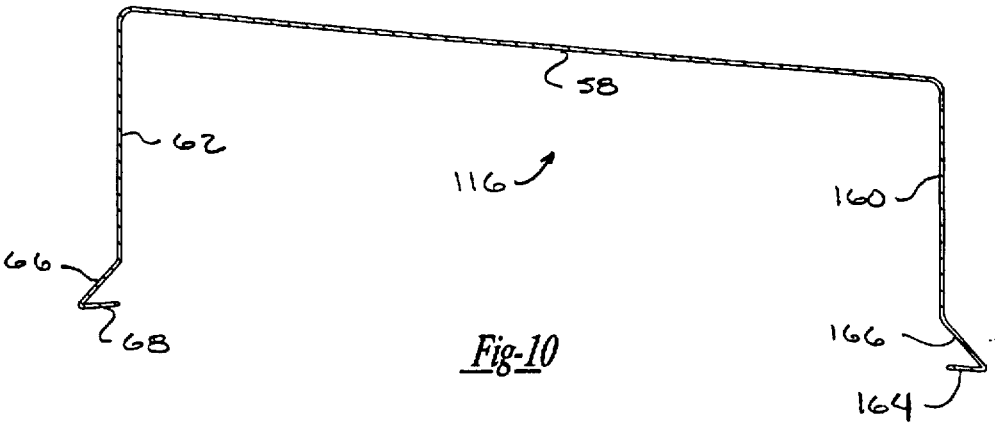
FIG. 10 is a cross-sectional view through the coping cap shown in FIG. 8.
Figure 8:
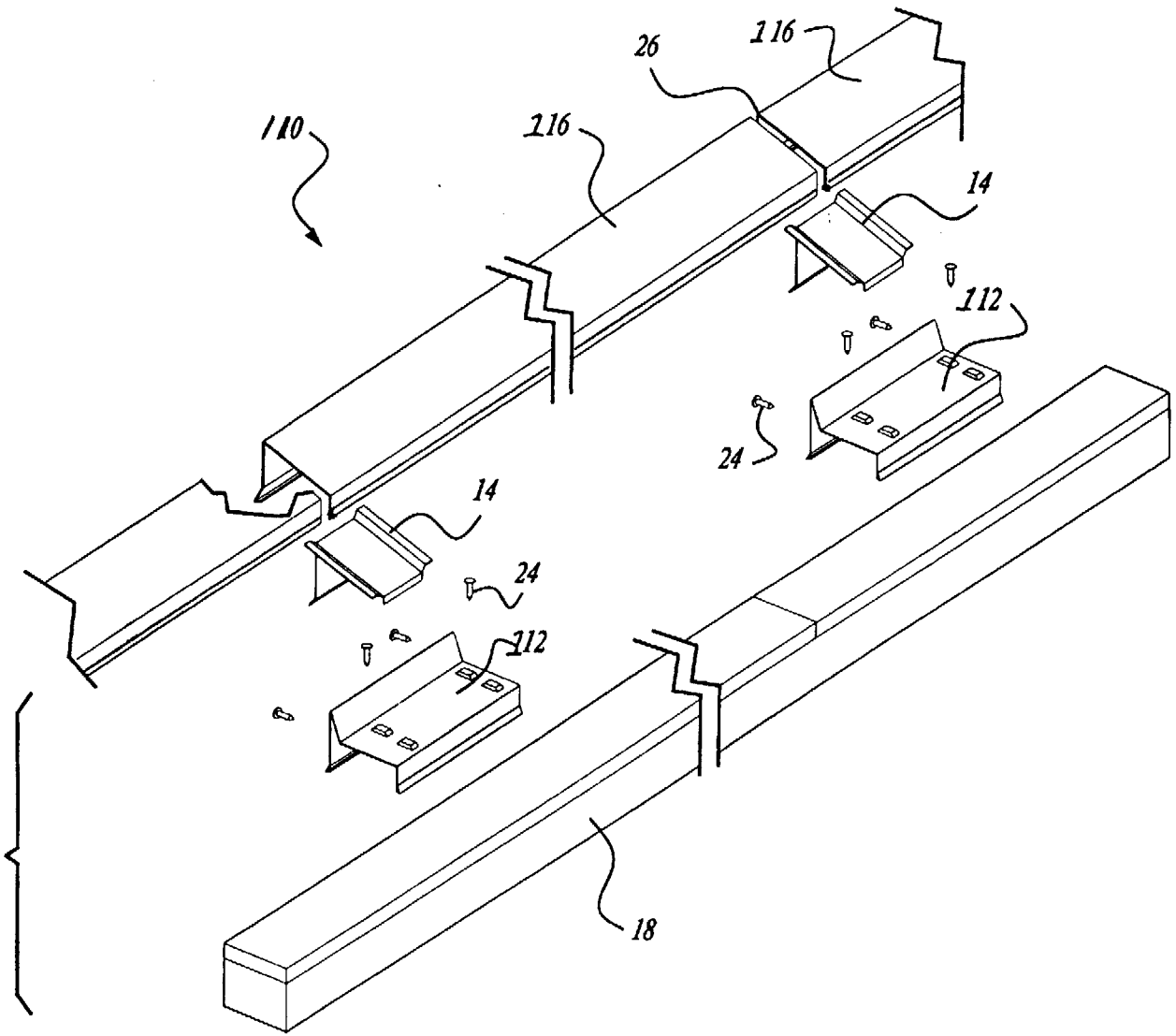
FIG. 8 is an exploded perspective view similar to FIG. 1 but illustrating a coping system in accordance with another embodiment of the present invention.

FIGS. 8–10 illustrate a coping system in accordance with another embodiment of the present invention which is designated generally by the reference numeral 110. Copying system 110 comprises a plurality of cleats 112, chair/joint covers 14, and caps 116. Cleats 112 are designed to replace cleats 12 in coping system 10 and caps 116 are designed to replace caps 16 in coping system 10. Both systems utilize chair/joint covers 14.

Referring to FIG. 9, cleat 112 comprises generally flat horizontal base 30, a rear lip 132, raised support member 34 and front lip 36. Thus, the difference between cleat 112 and cleat 12 is in the design of rear lip 132. Rear lip 132 extends downward from base 30 along the inside edge of parapet 18. The angle between base 30 and rear lip 132 is equal to 90° in the preferred embodiment in order to mate with parapet 18. The edge of rear lip 132 includes a lip 140 which is designed to extend away from parapet 18 to form a drip edge as will be explained later herein. Cleat 112 is secured to parapet 18 in a similar manner to cleat 12.

Referring now to FIG. 10, cap 116 comprises generally planar base 58, a rear lip 160 and front lip 62. Thus, the difference between cap 116 and cap 16 is in the design of rear lip 160 which is designed to mate with rear lip 132 of cleat 112. Rear lip 160 extends downward from base 58 along the outside of rear lip 44 of chair/joint cover 14 similar to rear lip 60 of cap 16. The angle between base 58 and rear lip 160 is smaller than the angle between base 42 and rear lip 44 of chair/joint cover 14 (91° in the preferred embodiment). This slightly smaller angle provides for a spring-like snap fit of cap 116 onto chair/joint cover 14 and cleat 112. The edge of rear lip 160 includes a lip 166 which when assembled to chair/joint covers 14 and cleats 112 mates with lip 140 of cleat 112 to stiffen the edge of cap 116 and define a drip edge for directing fluid flow away from the rear face of parapet 18. The edge of lip 166 forms a hook 164 which engages the edge of lip 140 to retain cap 116 on cleats 112 with chair/joint covers 14 being sandwiched between them. The spring-like action of rear lip 44 of chair/joint cover 14 and the spring-like action of wings 48 ensure the continuous engagement of hooks 164 and 68 with cleat 112. This continuous engagement allows cap 116 to remain in place and withstand environmental factors such as wind gusts and the like.

The function and operation of coping system 110 and the advantage of coping system 10 are the same as those described above for coping system 10.

While the above detailed description describes the preferred embodiment of the present invention, it should be understood that the present invention is susceptible to modification, variation and alteration without deviating from the scope and fair meaning of the subjoined claims.

What is claimed is:

1. A coping system for a parapet having an upper ledge, a rear face and a front face, said coping system comprising:

a plurality of cleats secured to said parapet in a predetermined spaced relation along said upper ledge of said parapet, each of said plurality of cleats including a base for being positioned adjacent to said upper ledge, a rear lip extending from said base for being positioned adjacent to said rear face and a front lip extending from said base for being positioned adjacent to said front face;

a chair disposed on each of said cleats, said chair including a base, a rear lip extending from said base disposed adjacent to said rear lip of said cleat, a front lip extending from said base disposed adjacent to said front lip of said cleat and a pair of wings extending from said base of said chair, said wings extending between said front lip of said chair and said rear lip of said chair; and a first cap extending between at least two of said cleats, said first cap including a rear hook in engagement with said rear lip of said cleat and a front hook in engagement with said front lip of said cleat, said wings of said chair engaging said first cap to bias said first cap away from said cleat to maintain the engagement of said rear hook with said rear lip of said cleat and to maintain the engagement of said front hook with said front lip of said cleat.

2. The coping system according to claim 1 wherein, each of said plurality of cleats includes a support member extending from said base of said cleat, said support member inclining said chair and said first cap with respect to said upper ledge.

3. The coping system according to claim 1 wherein, said wings extend the entire distance between said rear lip of said chair and said front lip of said chair.

4. The coping system according to claim 3 wherein, said wings engage said first cap over their entire length.

5. The coping system according to claim 1 wherein, said first cap includes a front lip having a drip edge.

6. The coping system according to claim 5 wherein, said first cap includes a rear lip having a drip edge.

7. The coping system according to claim 1 wherein, said first cap includes a rear lip having a drip edge.

8. The coping system according to claim 1 wherein, said wings sealingly engage said first cap.

9. The coping system according to claim 8 wherein, said chairs are made entirely of metal.

10. The coping system according to claim 1 wherein, said coping system comprises a second cap disposed adjacent to said first cap, said first and second caps engaging a common cleat and a common chair, said first and second caps defining a gap between adjacent ends, said gap being positioned above said common chair.

11. The coping system according to claim 10 wherein, said common chair sealingly engages said first and second caps.

12. The coping system according to claim 10 wherein, said common chair forms a gutter disposed below said gap.

13. A coping system for a parapet having an upper ledge, said coping system comprising:

first cleat secured to said upper ledge of said parapet, said first cleat having a rear lip and a front lip;

a first chair disposed on said first cleat;

a second cleat secured to said upper ledge of said parapet in spaced relation to said first cleat, said second cleat having a rear lip and a front lip;

a second chair disposed on said second cleat;

a third cleat secured to said upper ledge of said parapet in spaced relation to said second cleat, said third cleat having a rear lip and a front lip;

a third chair disposed on said third cleat;

a first cap engaging said first and second cleats, said first cap including a rear hook in engagement with said rear lips of said first and second cleats and a front hook in engagement with said front lips of said first and second cleats, said first and second chairs biasing said first cap away from said upper ledge to maintain said engagement of said rear and front hooks of said first cap; and a second cap engaging said second and third cleats, said second cap including a rear hook in engagement with said rear lips of said second and third cleats and front hook in engagement with said front lips of second and third cleats, said second and third chairs biasing said second cap away from said upper ledge to maintain said engagement of said rear and front hooks of said second cap.

14. The coping system according to claim 13 wherein, said first, second and third cleats each include a support member, said support members inclining said first, second and third chairs and said first and second caps with respect to said upper ledge.

15. The coping system according to claim 13 wherein, said first, second and third chairs each include a pair of wings extending the entire distance between said front and rear lips of said first, second and third cleats, respectively, said wings biasing said first and second caps away from said upper ledge.

16. The coping system according to claim 15 wherein, at least one of said pair of wings of said first and second chairs engages said first cap over their entire length and at least one of said pair of wings of said second and third chairs engages said second cap over their entire length.

17. The coping system according to claim 13 wherein, said first and second caps each include a front lip having a drip edge.

18. The coping system according to claim 17 wherein, said first and second caps each include a rear lip having a drip edge.

19. The coping system according to claim 13 wherein, said first and second caps each include a rear lip having a drip edge.

20. The coping system according to claim 13 wherein, said first and second chairs sealingly engage said first cap and said second and third chairs sealingly engage said second cap.

21. The coping system according to claim 13 wherein, said first, second and third chairs are made entirely of metal.

22. The coping system according to claim 13 wherein, said first and second caps define a gap between them, said gap being positioned above said second chair.

23. The coping system according to claim 22 wherein said second chair sealingly engages said first and second caps.

24. The coping system according to claim 22 wherein, said second chair forms a gutter disposed below said gap.

* * * * *